United States Patent [19]

Ando

[11] Patent Number: 4,542,270

[45] Date of Patent: Sep. 17, 1985

[54] SLIPPING CONNECTOR ASSEMBLY FOR APPLICATION TO MICROWAVE OVEN

[75] Inventor: Yuzi Ando, Yamatokoriyama, Japan

[73] Assignee: Sharp Kabushiki Kaisha, Osaka, Japan

[21] Appl. No.: 542,209

[22] Filed: Oct. 14, 1983

[30] Foreign Application Priority Data

Oct. 15, 1982 [JP] Japan ..... 57-156575[U]

[51] Int. Cl.[4] ..... H05B 6/68

[52] U.S. Cl. ..... 219/10.55 B; 219/10.55 R; 339/8 R; 339/94 R

[58] Field of Search ..... 219/10.55 B, 10.55 E, 219/10.55 F, 10.55 R; 99/421 TP; 339/8 R, 8 A, 8 P, 6 R, 6 A, 94, 102

[56] References Cited

U.S. PATENT DOCUMENTS 4,149,056 4/1979 Kaneshiro et al. ..... 219/10.55 R
4,409,452 10/1983 Oouchi et al. ..... 219/10.55 F X
4,427,866 1/1984 Pauly et al. ..... 219/10.55 B
4,430,541 2/1984 Day, Jr. ..... 219/10.55 R

*Primary Examiner*—Philip H. Leung
*Attorney, Agent, or Firm*—Birch, Stewart, Kolasch & Birch

[57] ABSTRACT

Disclosed is a slipping connector assembly built in a microwave oven. Connected to the output terminals of a temperature sensing probe that detects temperature of food being cooked on a turntable of a microwave oven. This slipping connector assembly is provided with mobile contacts that are connected to the output terminals of the probe and stationary contacts that come into contact with the mobile contacts, while the contact points between the mobile and stationary contacts are completely shielded by a shielding case.

Since the contact points between the mobile and stationary contacts are completely shielded by the shielding case, the contact points are perfectly free from oil and impurities, thus resulting in improved performance reliability of the entire mechanism of the slipping connector assembly.

5 Claims, 3 Drawing Figures

SLIPPING CONNECTOR ASSEMBLY FOR APPLICATION TO MICROWAVE OVEN

BACKGROUND OF THE INVENTION

The present invention relates to a microwave oven, more particularly, to a slipping connector installed to the oven ceiling that supports the food temperature sensing probe of a microwave oven incorporating a turntable.

To uniformly heat food, there is an apparatus called a "meat probe microwave oven", which uses a turntable in the cooking chamber and detects temperature of the food during cooking via a temperature sensing probe in contact with food so that the heating can be controlled in response to the temperature detected.

Such a microwave oven makes the temperature sensing probe in contact with the food rotate together with the turntable, while the output terminal of the temperature sensing probe is connected to the slipping connector that is secured to the ceiling of the microwave oven, and as a result, the food temperature is detected during cooking by the electrically connected slipping connector and control circuit of the microwave oven unit.

However, in the conventional slipping connectors, for example, in the prior art such as disclosed by the U.S. Pat. No. 4,149,056 "MICROWAVE OVEN WITH FOOD TEMPERATURE MEANS", the contact point between the mobile and stationary contacts of the slipping connector is exposed to the surrounding atmosphere of the oven containing oil and impurities inside the microwave oven, and so if the microwave oven is used for a long time, the contacts of both the mobile and stationary contact devices are contaminated or stained by oil and impurities which arise from the food being cooked. In other words, contact resistance between the mobile and stationary contacts eventually increases after the temperature sensing probe is used for a long time, thus causing the contacts to malfunction and so the food temperature is not detected at all during cooking.

OBJECT AND SUMMARY OF THE INVENTION

In light of the disadvantage described above, the present invention thus provides a slipping connector that inhibits the contact resistance to grow at all, even after using the temperature sensing probe for a long time.

In summary, the present invention provides an air-tight case that completely shields the contact points of the mobile and stationary contacts of the slipping connector installed in the microwave oven so that the contact points can be completely shielded from atmosphere contaminated by oil and impurities in the cooking chamber by effectively inhibiting an increase in the contact resistance even after using the microwave oven for a long period of time.

As described above, the slipping connector of a microwave oven as a preferred embodiment of the present invention provides an air-tight case that completely shields the contact points between the mobile and stationary contacts. As a result, the contact parts are perfectly shielded from the atmosphere inside the cooking chamber of a microwave oven containing oily fumes and impurities, thus enabling the entire detect mechanism to correctly and stably detect food temperature in the cooking chamber even after the microwave oven is used for a long period of time.

BRIEF DESCRIPTION OF THE DRAWINGS

The present invention will become better understood from the detailed description given hereinbelow and the accompanying drawings which are given by way of illustration only, and thus are not limitative of the present invention and wherein.

DETAILED DESCRIPTION OF THE INVENTION

Figure 1:
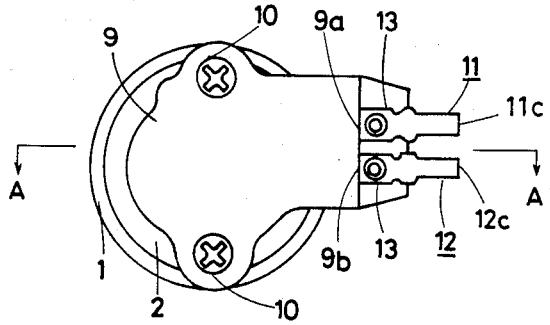
FIG. 1 is a plane view of a slipping connector as a preferred embodiment of the present invention.
Figure 2:
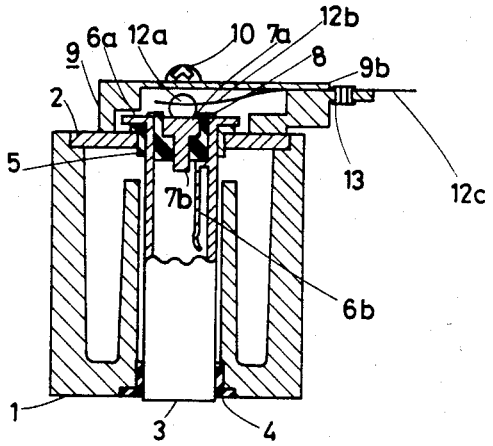
FIG. 2 is a sectional view taken along line A—A of a slipping connector shown in FIG. 1.

FIGS. 1 and 2 respectively show a plane and a A—A sectional view of a slipping connector as a preferred embodiment of the present invention.

A cylindrical relay jack 3 that has a cylindrical lid 2 which is provided with concentric holes, is coupled to a cylindrical choke unit 1 from the upright position, while the cylindrical relay jack 3, incorporating a a flange-type mobile contact at one end, is supported by the bearing 5 set in the circumference of the hole of sleeve 4 which is in the inner wall of a lower part of the choke unit 1, and also by the lid 2.

A mobile contact 6*a* and the other mobile contact 7*a* are respectively installed concentrically to the upper position of the relay jack 3 via an insulator 8. Contact surface of the mobile contact 6*a* is on the surface which is in the level identical to the contact surface of the other mobile contact 7*a* that is tightly inserted into the inner surface of the relay jack 3 via the cylindrical insulator 8.

The lower parts of the mobile contacts 6*a* and 7*a* are respectively provided with terminals 6*b* and 7*b* that are in contact with the output terminals of the temperature sensing probe (not illustrated). A stationary contact base 9 that secures both the stationary contact components 11 and 12, makes up an air-tight case which tightly shields the contact points between the mobile contacts 6*a* and 7*a*, while the stationary contact base 9 is secured to the microwave oven (not illustrated) by two pieces of screw 10.

Stationary contact components 11 and 12 are respectively made of phosphorated bronze plates each being provided with conductivity and an optimum elasticity, which are secured to the stationary contact base 9 by holdfast units 13 via holes 9*a* and 9*b*. The stationary contact base 9 provides holes 9*a* and 9*b*, through which the stationary contact components 11 and 12 respectively pass. To perfectly ensure the shielded effect at these holes, the stationary contact base 9 is made of an insulation material containing an expansion rate identical to that of the phosphorated bronze plates.

The stationary contact components 11 and 12 are of an identical structure, where the parts of these contacts respectively come into contact with the mobile contacts 6*a* and 7*a*. For example, the stationary contact part 12 is composed of a so-called carbon brush having its stationary contact 12*a* in contact with the mobile contact 7*a* which is composed of annealed carbon lump. A spring 12*b* that presses the mobile contact 7*a* for a contact operation is provided in a position near the center of the stationary contact component 12. A terminal 12*c* which is connected to the control circuit of the microwave oven (not illustrated) is extended from a stationary part secured by holdfast unit 13. The other stationary contact component 11 has a structure identical to the stationary contact component 12. Sationary contact 12*a* of the stationary contact component 12 is in a position near the center of the sliding part of a circular plane of the mobile contact 7*a*, while the stationary contact (not illustrated) is also in a position near the center of the mobile contact 6*a*.

In the structure described above, when the temperature sensing probe (not illustrated) which is connected to the relay jack 3 rotates, the relay jack 3 also rotates, causing the stationary contacts of the stationary contact components 11 and 12 to respectively move on the mobile contacts 6*a* and 7*a*. As a result, electric signals from the temperature sensing probe are transmitted to terminals 11*c* and 12*c* via the contact points of the mobile contacts 6*a* with 7*a* and the stationary contacts 11*a* and 12*a*.

In the structure of a slipping connector thus described, the contact points between the mobile and stationary contacts are completely shielded by the lid 2 and the stationary contact base 9 which concurrently makes up an air-tight shield case, thus permitting the contact points to be completely shielded from the oily and stained or contaminated atmosphere inside the cooking chamber of the mocrowave oven.

Consequently, contact points between the mobile and stationary contacts are completely prevented from being exposed to even the slightest amount of oil and impuritites arising from the food being cooked in the chamber. This permits the contact points to constantly retain a satisfactory conductivity without causing the contact resistance to increase.

Figure 3:
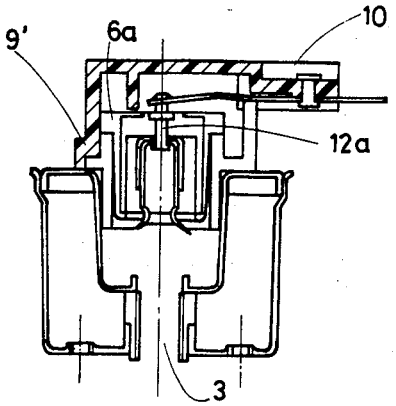
FIG. 3 is a sectional view of a slipping connector as another preferred embodiment of the present invention.

FIG. 3 shows another preferred embodiment of the present invention, in which, an air-tight shield case 9′; which is concurrent with the stationary contact base, is composed of a molded plastic product, which permits the contact points between the mobile and stationary contacts to be completely shielded.

Structures of the preferred embodiments have been thus described, in which each two pairs of the mobile and stationary contacts are respectively provided. However, the present invention is not intended to limit the number of the contacts, and the slipping connector embodied by the present invention may provide more than two pairs of the mobile and stationary contacts.

What is claimed is:

1. In a microwave oven which utilizes a turntable to rotate food being cooked in a cooking chamber and a temperature sensing probe in contact with the food, output terminals of the probe being connected to a slipping connector assembly, said slipping connector assembly comprising:

a slip connector including mobile contacts connected to said output terminals of said temperature sensing probe and stationary contacts having continuous points of contact with said mobile contacts and with a control circuit of said microwave oven; and an air-tight shielding case that shields said points of contact between said mobile and stationary contacts of said slip connector from the atmosphere inside the cooking chamber of the oven.

2. The slipping connector assembly of claim 1, wherein said shielding case comprises a molded plastic case.

3. The slipping connector assembly of claim 1, wherein said shielding case is secured to said microwave oven and while shielding said respective contacts from the atmosphere inside the cooking chamber of the oven also supports said stationary contacts.

4. A microwave oven for cooking food which uses a turntable in a cooking chamber and detects temperature of the food during cooking via a temperature sensing probe in contact with food so as to control heating of the food in response to said temperature detected comprising:

a turntable included in a microwave oven chamber so that the food is cooked and rotated therein;

a food temperature-sensing probe for monitoring the temperature of the food placed in said microwave oven chamber for cooking purposes;

a slip connector including mobile contacts connected to output terminals of said temperature sensing probe and stationary contacts connected to a control circuit of said microwave oven and having continuous points of contact with said mobile contacts; and an air-tight shielding case which shields or seals said points of contact between said stationary contacts and said mobile contacts and said connection to said control circuit of said slip connector from the atmosphere inside the cooking chamber of the oven.

5. The microwave oven of claim 4, wherein said shielding case of said slipping connector assembly is secured to said microwave oven and supports said stationary contacts while performing said sealing function.

* * * * *